United States Patent [19]

Sims, Jr.

[11] 3,999,025

[45] Dec. 21, 1976

[54] LOW PROFILE TACTILE FEEDBACK KEYBOARD SWITCH ASSEMBLY

[75] Inventor: Dewey M. Sims, Jr., Westland, Mich.

[73] Assignee: Burroughs Corporation, Detroit, Mich.

[22] Filed: July 30, 1975

[21] Appl. No.: 600,400

[52] U.S. Cl. ..... 200/159 B; 200/5 R; 200/5 A; 200/67 D

[51] Int. Cl.[2] ..... H01H 13/44

[58] Field of Search ..... 200/5 R, 5 A, 1 R, 67 D, 200/67 DA, 67 DB, 159 R, 159 A, 159 B, 329–340

[56] References Cited

UNITED STATES PATENTS

| | | | |
|---|---|---|---|
| 3,600,528 | 8/1971 | Leposavic | 200/159 B X |
| 3,742,157 | 6/1973 | Leposavic | 200/159 B X |
| 3,800,104 | 3/1974 | Lien et al. | 200/159 A X |
| 3,870,840 | 3/1975 | Rivetta et al. | 200/159 A X |
| 3,909,564 | 9/1975 | Scheingold et al. | 200/159 B X |

*Primary Examiner*—James R. Scott
*Attorney, Agent, or Firm*—Manuel Quiogue; Kevin R. Peterson

[57] ABSTRACT

A tactile feedback keyboard switch assembly having opposing upwardly inclined leaf springs for biasing an actuating keytop which has downwardly extending members for causing selective engagement of contact members disposed in a diaphragm type contact assembly beneath the leaf springs upon depression of the keytop. A bifurcated action is achieved by providing interconnected contact members for each of the downwardly extending members.

15 Claims, 7 Drawing Figures

LOW PROFILE TACTILE FEEDBACK KEYBOARD SWITCH ASSEMBLY

BACKGROUND OF THE INVENTION

This invention generally relates to selectively actuable switches for completing selected electrical conductive paths in a keyboard apparatus. Specifically, this invention relates to a keyboard switch assembly having opposing inclined leaf spring members as a biasing mechanism for a keytop which is configured to cause selective engagement of contact members upon manual actuation of the keytop. The contact members are disposed in a diaphragm type contact assembly between the leaf springs in registration with the actuating keytop.

Keyboards having switch assemblies for selectively interconnecting electrical circuits are used in electronic calculators and the like. However, prior art devices have certain disadvantages such as complexity due to a large number of parts and the resulting high production cost. A further disadvantage of prior art devices is the bulkiness of the keyboard switch assembly. Still other disadvantages of the prior art include lack of tactile feedback as well as the lack of adjustability in the amount of force required to depress the individual switches.

SUMMARY OF THE INVENTION

The present invention overcomes the disadvantages of the prior art devices by providing novel features which accomplish certain desired advantages.

It is therefore an object of this invention to provide an improved keyboard switch assembly having relatively few and simple parts.

It is a further object of this invention to provide an improved keyboard switch for use with a diaphragm type contact assembly.

Still another object is to provide a keyboard switch having tactile feedback for identifying depression of the keytop.

Another object of the invention is to provide an improved keyboard switch assembly which is adjustable as to the force required to depress the switch.

A further object of the invention is to provide a keyboard switch having improved electrical contact between selectively contacting members.

An even further object of this invention is to provide a keyboard switch having a more reliable means of contact engagement.

The keyboard switch assembly of the present invention achieves the above and other objects by providing a pair of opposing upwardly inclined leaf springs to achieve an over-center spring configuration as the biasing members for a selective key switching element in a keyboard apparatus. The leaf springs are fixedly located at their respective lower ends and are mounted to allow movement relative to each other. The upper ends of the leaf springs are interlocked to prevent lateral movement while allowing longitudinal adjustment of the springs to vary the preload force. A keytop is mounted within a guide base to deflect the leaf springs into a bowed condition. The keytop has lobed protrusions which extend downward on either side of the leaf springs for actuating contact members which are disposed in registration with the keytop in a diaphragm type contact assembly below the leaf springs of the keyboard. The contact assembly includes a lower printed circuit board having contact pads, a diaphragm above the PC board and dielectrically spaced therefrom with corresponding contact pads facing the pads on the PC board, and a rubber cover over the diaphragm. Actuation of the keytop presses the lobed protrusions against the rubber cover which in turn pushes the diaphragm contacts through apertures in a dielectric spacer into engagement with corresponding contacts on the PC board. A bifurcated action is achieved by providing interconnected contacts for actuation by each lobed protrusion.

DETAILED DESCRIPTION OF THE PREFERRED EMBODIMENT

Figure 1A:
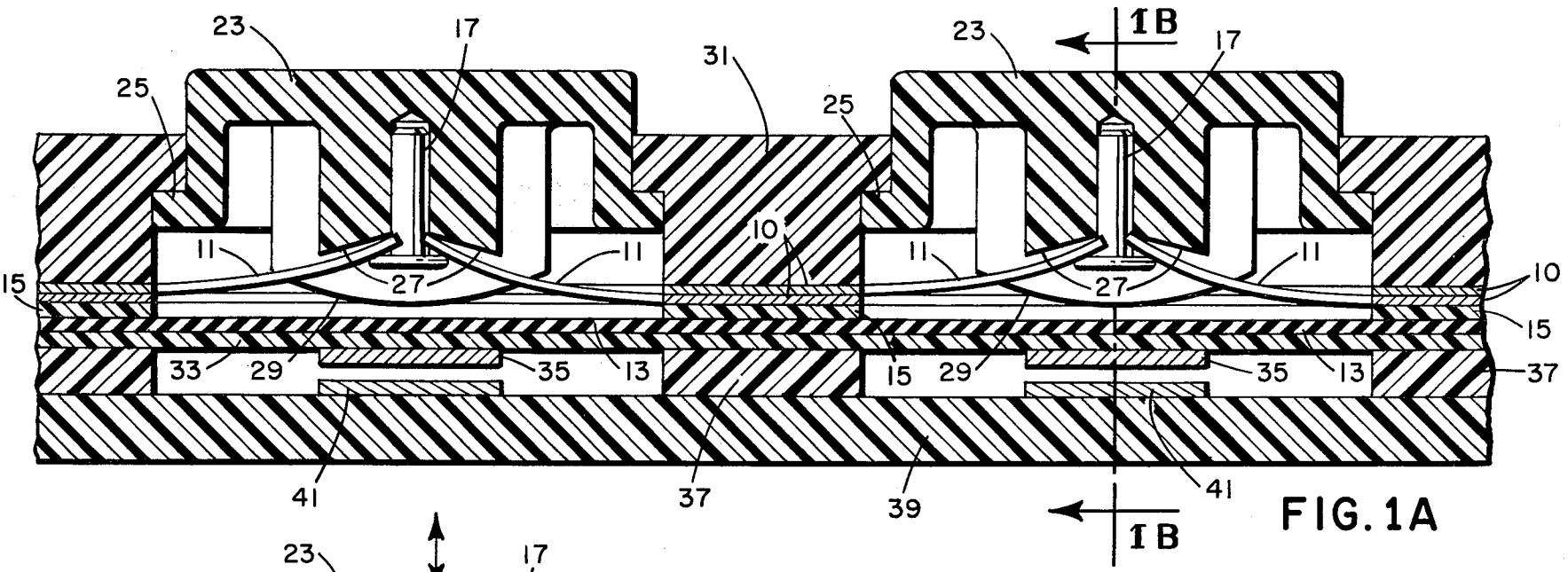
FIGS. 1A and 1B are cross section views of the key switch assembly of the present invention along the longitudinal and transverse axes of the leaf springs, respectively, with a locator pin for preventing lateral movement of the leaf springs.
Figure 1B:
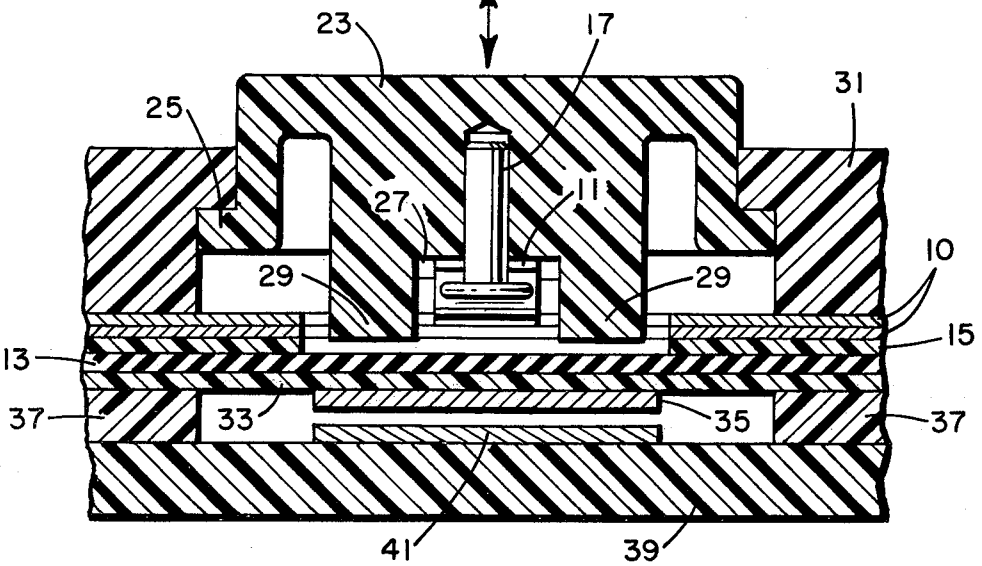
Figure 3:
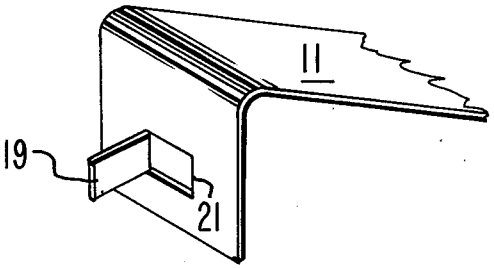
FIG. 3 is a perspective view of a leaf spring with a tang and a cutout which may be used in the present invention.
Figure 2:
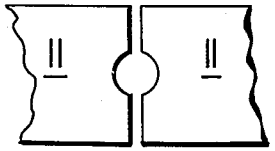
FIG. 2 is a top view of the springs for use with a locator pin showing the semi-circular cutouts for holding the locator pin.

The switch assembly of the present invention includes a pair of upwardly inclined leaf springs 11 separated from a rubber cover 13 by spacers 15. A locator pin 17, as shown in FIG. 1, may be frictionally gripped by the upper ends of the leaf springs 11 which have cutouts as shown in FIG. 2 for accepting the locator pin 17. This prevents lateral displacement of the leaf springs 11 while allowing longitudinal displacement. That is, the upper ends of the leaf springs 11 are constrained to displacement away from and toward each other only. FIG. 3 shows the leaf spring 11 as having a tang 19 and a cutout 21 for interlocking with an opposing leaf spring to prevent lateral movement while also allowing longitudinal displacement. Thus, either embodiment as disclosed in FIGS. 2 and 3 provides for longitudinally constrained displacement.

A keytop 23 having a circumferential retaining shoulder 25 and inclined surfaces 27 on its bottom side rests upon the leaf springs 11 to apply an actuating force against the leaf springs 11 in the vicinity of the upper ends of the leaf springs 11 and thereby causes the leaf springs 11 to buckle downwardly. Lobed protrusions 29 are part of the keytop 23 and extend downwardly on either side of the leaf springs 11 toward the rubber cover 13. A guide base 31 is positioned above the rubber cover 13 and surrounds the outer perimeter of the keytop 23 to locate the keytop 23 in position and to limit the upward movement of the keytop 23 by engaging the retaining shoulder 25.

Beneath and adjacent the rubber cover 13 is a diaphragm 33 having interconnected upper contact pads 35 facing downward and located beneath the lobed protrusions 29. A dielectric separator 37 is located beneath the diaphragm 33 and has apertures cut in appropriate locations below each of the lobed protrusions 29 to allow downward displacement of the upper contact pads 35 when the keytop 23 is depressed. Beneath the diaphragm 33 and the dielectric separator 37 is a printed circuit board 39 which has interconnected lower contact pads 41 in registration with the interconnected upper contact pads 35. Appropriate leads (not shown) are connected to the contact pads 35, 41 and engagement of the respective contact pads 35, 41 completes a desired electrical conductive path.

The opposing inclined leaf springs 11 together form an over-center leaf spring arrangement which provides for tactile feedback to indicate sufficient depression of the keytop for causing engagement of the contact pads 35, 41. Depression of the keytop 23 causes the inclined surfaces 27 to push on the upper ends of the leaf springs 11, thus causing a compression force at each of the upper ends of the leaf springs 11. This compression force causes each of the leaf springs 11 to bow downwardly which in turn allows further downward displacement of the upper ends of the leaf springs 11. This bowing action results in a continued increase in the force required to depress the keytop until the vertical component of the compression force required to bow the leaf springs reaches a maximum. When the maximum value of the vertical component is reached, the upper and lower contact pads 35, 41 have not yet engaged. Past this point, the vertical component of the compression force required continuously decreases rapidly with further downward displacement of the keytop 23. This decreases continues until the lobed protrusions 29 have pressed the upper contact pads 35 against the corresponding lower contact pads 41. Thus the rapid decrease in resistance and the subsequent sudden stop indicates to the operator that electrical switching contact has been made.

The above described structure also accomplishes a desired reliable bifurcated electrical contact by providing the lobed protrusions 29 for causing engagement of the electrical contact pads 35, 41 beneath each lobed protrusion 29. Since the contact pads 35, 41 beneath the keytop 23 are interconnected on each level, upper and lower, only one of the lobed protrusions 29 has to be fully depressed to complete the desired electrical conductive path. The lobed ends of the lobed protrusions 29 accomplish a desired teetering motion when they are pressed against the rubber cover 13. Furthermore, the lobed shape provides a high amount of pressure which is exerted upon the rubber cover 13 and the diaphragm 33. The bifurcated structure, the teetering motion, and the specific shape of the lobed protrusions cooperate to establish an extremely reliable electrical contact between the upper and lower contact pads 35, 41 when the keytop 23 is depressed.

Figure 6:
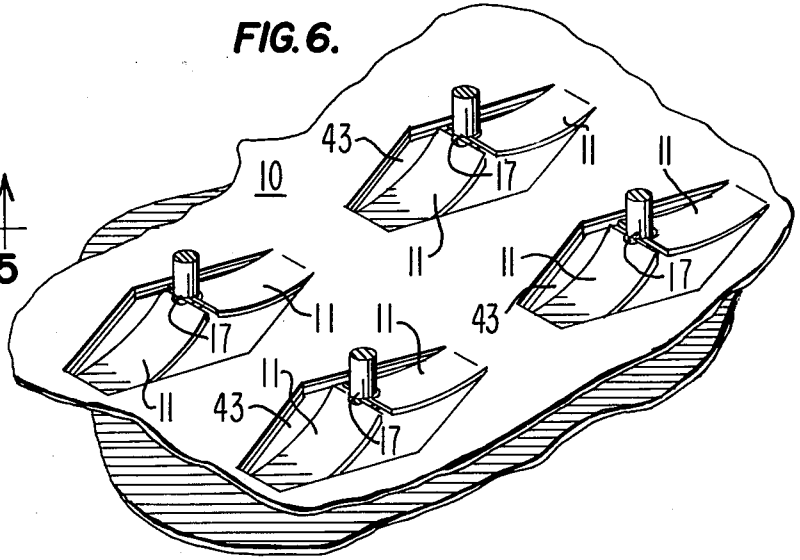
FIG. 6 is a fragmentary perspective view of a plurality of key switch assemblies showing the locator pin thereof disposed in cooperating relationship with the leaf springs of a pair of overlapped plates, the plates, as illustrated in FIG. 4, being disposed at 180° from one another.
Figure 4:
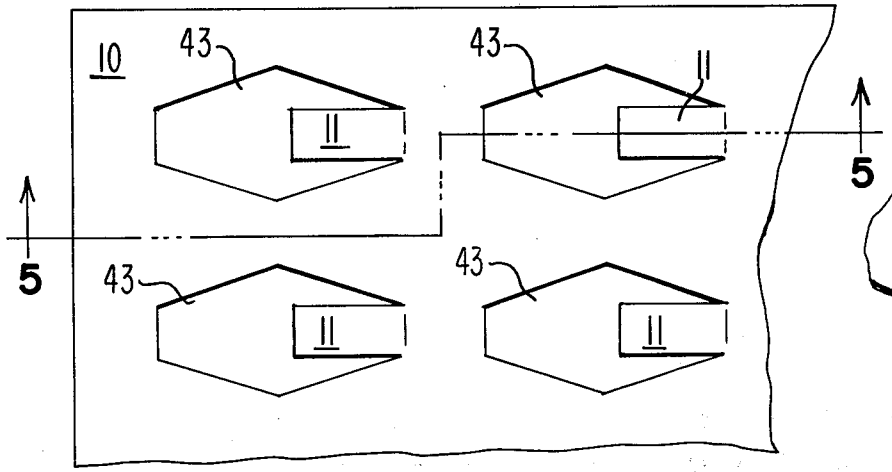
FIG. 4 shows a top view of a plate having leaf springs formed thereon for use in a keyboard switch assembly of the present invention.
Figure 5:
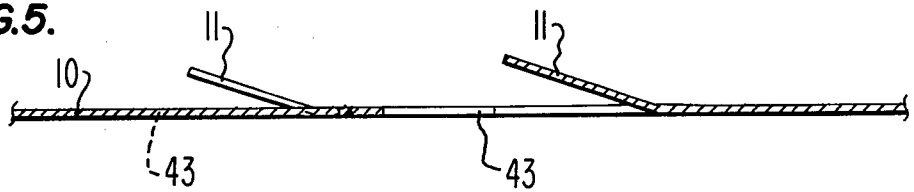
FIG. 5 is a side view of the plate of FIG. 4.

The leaf springs 11 may be formed on a spring metal plate 10 as shown in FIGS. 4 and 5. It is evident that although only four springs are shown, any desired number may be formed on the metal plate 10. The spring metal plate 10 has the leaf springs 11 oriented in the same direction and are formed thereon by making a plurality of cutouts 43. The cutouts 43 are dimensioned to allow a bottom plate 10 to be placed directly beneath an upper plate 10 with the springs 11 on the respective plates being oriented in opposite directions and with the springs 11 of the bottom plate 10 extending upward through the cutouts 43 of the upper plate 10, as illustrated in FIG. 6. The leaf springs 11 shown in FIGS. 4 and 5 do not have semi-circular cutouts for accepting the locator pin 17 or the tang 19 and cutout 21 as shown in FIG. 2. However, it is apparent that the leaf springs 11 may be appropriately manufactured to provide either mechanism for constraining the relative movement of the leaf springs 11.

Using the above structure having the overlying spring metal plates 10 allows the adjustment of the preloaded force of all the switch assemblies formed on a pair of plates 10 by displacement of the plate 10 along the longitudinal axes of the leaf springs 11. This may be readily accomplished by a camming mechanism or a screw-type adjustment mechanism which can incrementally displace the overlying plates 10 and also lock the plate 10 in a desired position.

The foregoing has been a recital of a specific embodiment of the present invention which is not limited to this embodiment, but which invention is limited only by the scope of the following claims.

What is claimed is:

1. A switch assembly comprising:

contact means having contact members for engagement in response to pressure actuation;

a displaceable actuating member proximately located adjacent said contact means for applying an actuating pressure to said contact means to engage said contact members when manually displaced toward said conact means; and planar biasing means for yieldingly resisting displacement of said actuating member toward said contact means, said biasing means compressing into a bowed configuration upon displacement of said actuating member and being adjustable as to the amount of resistance said biasing means exerts.

2. The switch assembly of claim 1 wherein said planar biasing means comprises:

a plurality of leaf spring members positioned to form an over-center spring, said leaf spring members being biased into a bowed configuration by displacement of said actuating member; and means for allowing sufficient relative displacement of said leaf spring members for adjustment of the amount of resistance said leaf springs exert.

3. The switch assembly of claim 2 wherein said plurality of leaf spring members comprises a pair of opposing inclined leaf spring members having respective opposing ends located above their respective distal ends.

4. The switch assembly of claim 3 wherein said displacement allowing means comprises at least one tang and one cutout formed on each of the opposing ends of said leaf spring members for interlocking the opposing ends of said leaf spring members.

5. The switch assembly of claim 3 wherein said displacement allowing means comprises a pin-shaped member frictionally engaged between the opposing ends of said leaf spring members.

6. A switch assembly comprising:

a rigid planar member having a first set of interconnected electrical contacts on the top surface portion thereof;

a flexible diaphragm dielectrically separated from and above said planar member, said diaphragm having a second set of interconnected electrical contacts on the bottom surface thereof in registration with said first set of interconnected electrical contacts;

an actuating member mounted above said flexible diaphragm for displacement toward said planar member and said diaphragm, said actuating member being located and configured to deflect said second set of interconnected contacts into engagement with said first set of interconnected electrical contacts; and planar biasing means for yieldingly resisting movement of said actuating member toward said flexible diaphragam, said biasing means compressing into a bowed configuration upon displacement of said actuating member and being adjustable as to the amount of resistance said biasing means exerts.

7. The switch assembly of claim 6 wherein said planar biasing means comprises:

a plurality of leaf spring members adapted to form an overcenter spring, said leaf spring members being biased into a bowed configuration by displacement of said actuating member; and means for allowing sufficient relative displacement of said leaf spring members for adjustment of the amount of resistance said leaf springs exert.

8. The switch assembly of claim 7 wherein said plurality of leaf spring members comprises a pair of opposing inclined leaf spring members having respective opposing ends located above their respective distal ends.

9. The switch assembly of claim 8 wherein said displacement allowing means comprises at least one tang and one cutout formed on each of the opposing ends of said leaf spring members for interlocking the opposing ends of said leaf spring members.

10. The switch assembly of claim 9 wherein said displacement allowing means comprises a pin-shaped member frictionally engaged between the opposing ends of said leaf spring members.

11. A switch assembly comprising:

a rigid planar member having a first set of interconnected individual electrical contacts on the top surface portion thereof;

a flexible diaphragm dielectrically separated from and above said planar member, said diaphragm having a second set of interconnected individual electrical contacts on the bottom surface thereof, said second set of electrical contacts having an equal number of contacts as said first set and being in registration with said first set;

an actuating member mounted above said flexible diaphragm for substantially perpendicular displacement toward said diaphragm;

a plurality of lobed protrusions extending from said actuating member toward said diaphragm in registration with corresponding contacts of said first and second sets of electrical contacts, said protrusions for causing engagement of selected contacts of said first and second set of electrical contacts when said actuating member is displaced against said diaphragm; and planar biasing means for yieldingly resisting movement of said actuating member toward said flexible diaphragm, said biasing means compressing into a bowed configuration upon displacement of said actuating member and being adjustable as to the amount of resistance exerted upon said actuating member.

12. The switch assembly of claim 11 wherein said planar biasing means comprises:

a plurality of leaf spring members adapted to form an over-center spring, said leaf spring members being biased into a bowed configuration by displacement of said actuating members; and means for allowing sufficient relative displacement of said leaf spring members for adjustment of the amount of resistance said leaf springs exert.

13. The switch assembly of claim 12 said plurality of leaf spring members comprises a pair of opposing inclined leaf spring members having respective opposing ends located above their respective distal ends.

14. The switch assembly of claim 13 wherein said displacement allowing means comprises at least one tang and one cutout formed on each of the opposing ends of said leaf spring members for interlocking the opposing ends of said leaf spring members.

15. The switch assembly of claim 14 wherein said displacement allowing means comprises a pin-shaped member frictionally engaged between the opposing ends of said leaf spring members.

* * * * *